US012729937B1

(12) United States Patent
Segal et al.

(10) Patent No.: US 12,729,937 B1
(45) Date of Patent: Sep. 8, 2026

(54) COMPACT ENCAPSULATED EXPLODING FOIL INITIATOR ASSEMBLY

(71) Applicant: Reynolds Systems, Inc., Middletown, CA (US)

(72) Inventors: John P. Segal, Cobb, CA (US); Christopher J. Nance, Athens, AL (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 19/284,237

(22) Filed: Jul. 29, 2025

(51) Int. Cl.
*F42B 3/12* (2006.01)

(52) U.S. Cl.
CPC ..... *F42B 3/12* (2013.01)

(58) Field of Classification Search
CPC ..... F42B 3/12
USPC ..... 102/200
See application file for complete search history.

(56) References Cited

U.S. PATENT DOCUMENTS

| | | | | |
|---|---|---|---|---|
| 3,670,654 | A * | 6/1972 | Billot | F42C 11/00 89/1.55 |
| 7,581,496 | B2 | 9/2009 | Hennings et al. | |
| 10,267,605 | B1 * | 4/2019 | Meadows | F42B 3/12 |
| 10,557,692 | B1 | 2/2020 | Amendola et al. | |
| 10,794,670 | B1 * | 10/2020 | Nance | F42B 3/11 |
| 10,871,354 | B2 | 12/2020 | Amendola et al. | |
| 10,935,352 | B1 | 3/2021 | Nance et al. | |
| 11,448,487 | B1 | 9/2022 | Morales et al. | |
| 11,525,653 | B1 | 12/2022 | Nance et al. | |
| 11,644,286 | B1 | 5/2023 | Morales et al. | |
| 12,259,223 | B1 * | 3/2025 | Morales | F42B 3/124 |
| 12,422,229 | B1 * | 9/2025 | Nance | F42B 3/103 |
| 2012/0199030 | A1 * | 8/2012 | Biggs | F42B 3/124 102/202.7 |

FOREIGN PATENT DOCUMENTS

| | | | | |
|---|---|---|---|---|
| WO | WO-2016134028 | A1 * | 8/2016 | F42B 3/125 |

* cited by examiner

*Primary Examiner* — Samir Abdosh
(74) *Attorney, Agent, or Firm* — Reising Ethington P.C.

(57) ABSTRACT

A compact encapsulated initiator assembly includes an initiator chip having a plurality of bridge contacts; a first terminal, including a first terminal end facing an opposite axial direction, configured to releasably and electrically couple with an electrical conductor of ordnance, and a first chip end that electrically couples with one of the bridge contacts; a second terminal, including a second terminal end, configured to releasably and electrically couple with another electrical conductor of ordnance, and a second chip end that electrically couples with another of the bridge contacts; and a shaped composite housing encapsulating at least some of the initiator chip, the first terminal, and the second terminal, such that at least a portion of an outer diameter of the first terminal end and an outer diameter of the second terminal end are positioned nearer a center axis than an outer edge of the initiator chip.

11 Claims, 2 Drawing Sheets

COMPACT ENCAPSULATED EXPLODING FOIL INITIATOR ASSEMBLY

TECHNICAL FIELD

The present application relates to exploding foil initiators (EFIs) and, more particularly, to packaging of EFIs.

BACKGROUND

Energetic ordnance has been included in a number of different devices, such as military weapons or as rocket propellant, and exists in a wide variety of different configurations. In some applications, the ordnance is selectively functioned with a fuze, such as an exploding bridgewire detonator, to ignite the ordnance. However, modern ordnance has increasingly been functioned using exploding foil initiators (EFIs). The EFIs can more reliably remain functional in a variety of environmental conditions and ordnance applications than their predecessors. It would be helpful to increase the resilience of the EFI assemblies and also extend the service life of the EFI assemblies.

SUMMARY

In one implementation, a compact encapsulated initiator assembly includes an initiator chip, formed on an electrically non conductive substrate, having a plurality of bridge contacts; a first terminal, including a first terminal end facing an opposite axial direction, configured to releasably and electrically couple with an electrical conductor of ordnance, and a first chip end that electrically couples with one of the bridge contacts; a second terminal, including a second terminal end, configured to releasably and electrically couple with another electrical conductor of ordnance, and a second chip end that electrically couples with another of the bridge contacts; and a shaped composite housing encapsulating at least some of the initiator chip, the first terminal, and the second terminal, such that at least a portion of an outer diameter of the first terminal end and an outer diameter of the second terminal end are positioned nearer a center axis than an outer edge of the initiator chip.

DETAILED DESCRIPTION

A compact encapsulated initiator assembly can include an EFI having a first terminal electrically coupled to an initiator chip and a second terminal electrically coupled to the initiator chip. The terminals can be formed from an initially-planar electrically conductive material that is deformed to have terminal ends configured to releasably couple to electrical connectors at the ordnance the initiator assembly is used with. The terminal ends can be substantially perpendicular to the EFI such that the terminal ends may be within the footprint of the EFI from a plan view perspective, helping minimize the diameter of the compact encapsulated EFI assembly. The EFI, the first terminal, the second terminal, as well as the terminal ends can be encapsulated in a solid substrate that provides a fluidic seal around those components preventing degradation from environmental elements. The terminal ends of the first terminal and the second terminal can be accessed through apertures formed in the solid substrate permitting the insertion of the electrical conductors.

Figure 1:
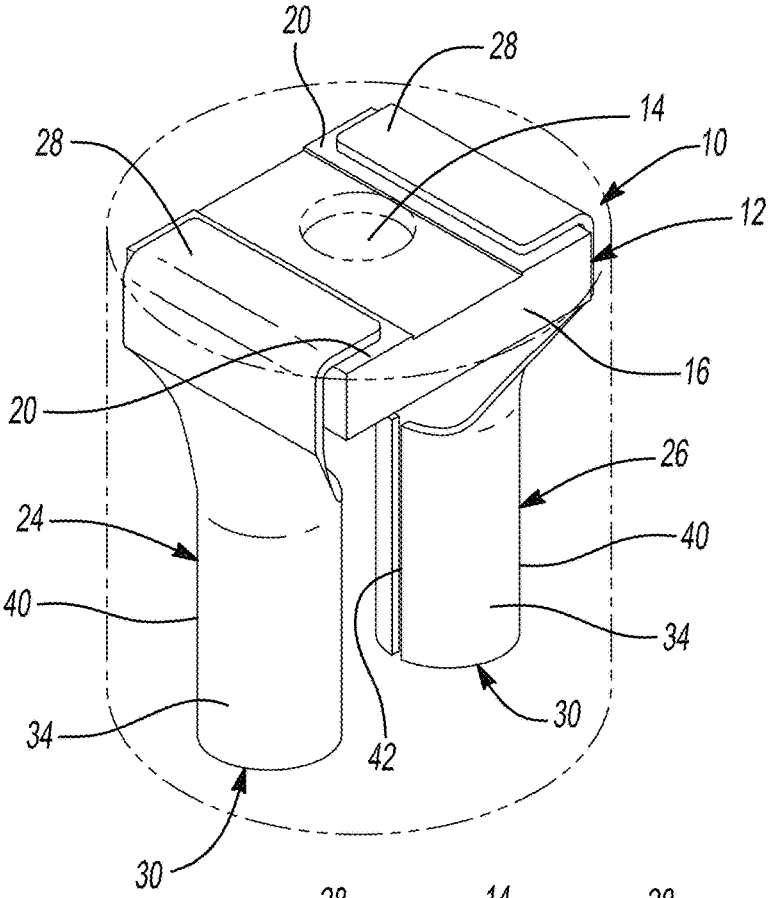
FIG. 1 is an isometric view depicting an implementation of a compact encapsulated initiator assembly.
Figure 2:
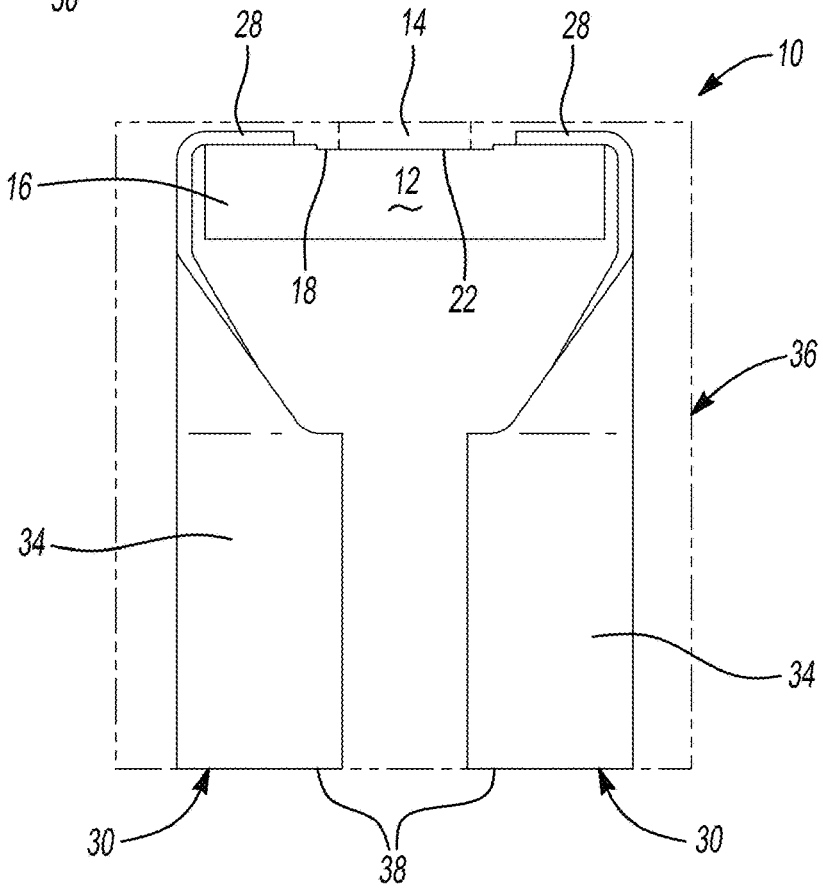
FIG. 2 is a profile view depicting an implementation of a compact encapsulated initiator assembly.
Figure 3:
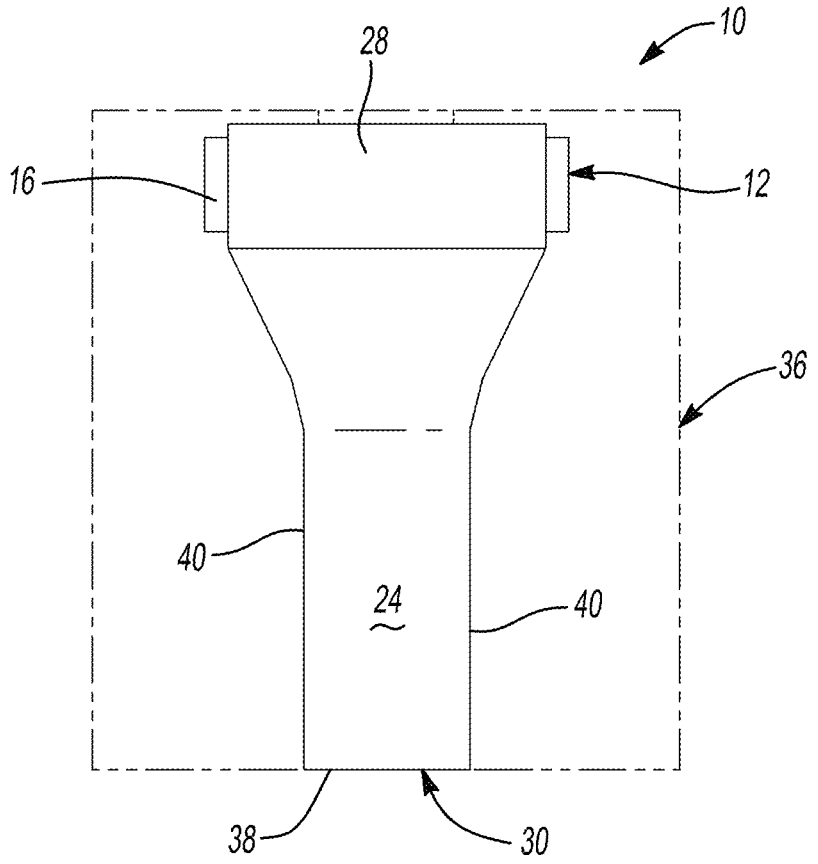
FIG. 3 is another profile view depicting an implementation of a compact encapsulated initiator assembly.
Figure 4:
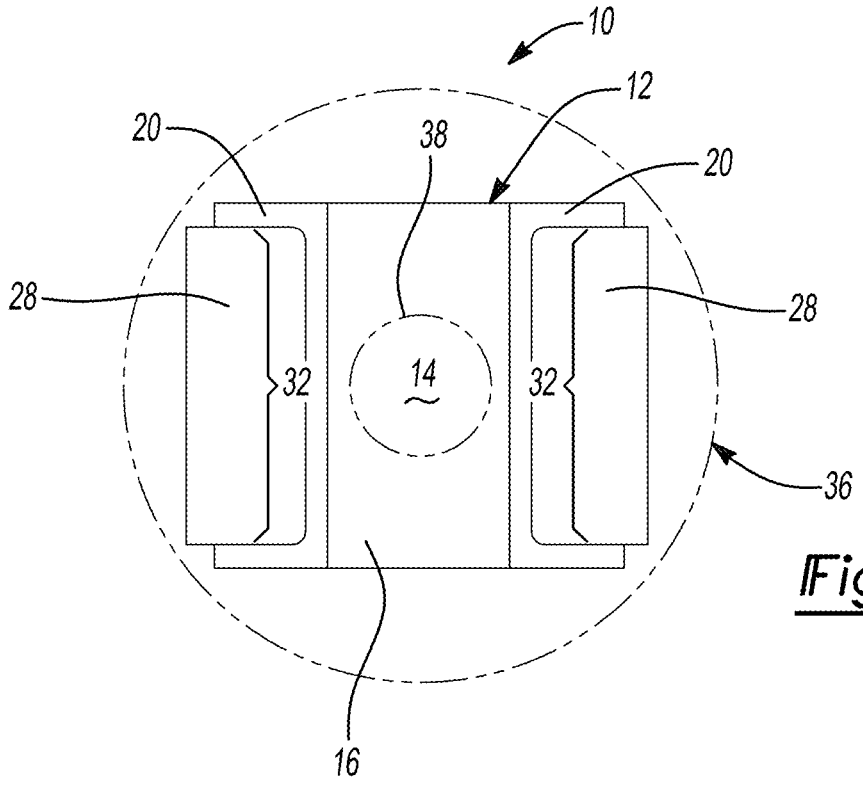
FIG. 4 is a plan view depicting an implementation of a compact encapsulated initiator assembly.

An implementation of the compact encapsulated initiator assembly 10 is shown in FIGS. 1-4. The assembly 10 includes an initiator chip 12 that is configured to initiate a detonation event in an input charge 14 when the initiator chip 14 is operated. The initiator chip 12 can comprise an electrically non-conductive substrate 16, a bridge 18 and a pair of bridge contacts 20. The bridge 18 and the bridge contacts 20 can be formed of one or more layers of one or more types of metal that can be vapor deposited onto the substrate 16. It will be appreciated, however, that the initiator chip 12 can be any type of device for initiating a combustion event, a deflagration event, an explosion event or a detonation event and could be electronically-actuated or passively activated. In one implementation, the initiator chip 12 can be an exploding foil initiator (EFI) or a low-energy exploding foil initiator (LEEFI). A flyer layer 22 can be formed of a suitable material, such as polyamide, and can be mounted to the initiator chip 14 so as to overlie and abut the bridge 18. One implementation of an EFI is described in U.S. application Ser. No. 11/828,032 the entire contents of which are incorporated by reference. However, other initiator chips may be possible. Examples of other suitable initiator chips include exploding bridge wire initiators, squibs, SCB semi-conductor bridge devices and thin film bridge initiators.

A first terminal 24 and a second terminal 26 are electrically coupled to the bridge contacts 20 at chip ends 28. The first terminal 24 and the second terminal 26 can each include terminal ends 30, distal from the chip ends 28, that are configured to releasably couple to electrical connectors (not shown) at the ordnance the initiator assembly is used with. The first terminal 24 and the second terminal 26 can be formed from an electrically conductive material that exists initially in a planar form. That is, the electrically conductive material can have a uniform thickness at any point along its body. In one implementation, the electrically conductive material can be sheet copper or sheet aluminum, but other possibilities exist. The first terminal 24 and the second terminal 26 can be created by forcibly deforming the electrically conductive material around a mandrel or a form having a male mold of the first terminal 24 or the second terminal 26. Alternatively, the electrically conductive material can be fed into a metal processing machine that stamps, bends, and/or trims the electrically conductive material into the final shape of the first terminal 24 and the second terminal 26.

In one implementation, the first terminal 24 and the second terminal 26 can be substantially similarly shaped such that they are electrically coupled to the bridge contacts 20 on opposite sides of the initiator chip 12. For instance, the first terminal 24 and the second terminal 26 can have chip ends 28 with a planar section 32 articulated perpendicularly relative to the terminal ends 30. The planar section 32 can be electrically conductive such that it engages and electrically couples with the bridge contacts 20. The planar section 32 can be electrically coupled to the bridge contacts 20 via soldering, electrically conductive adhesive, or similar electrical connection. The terminal ends 30 can be deformed from a planar shape to form female cylindrical electrical connectors capable of releasably receiving prong shaped electrical conductors. The terminal ends 30 can be articulated such that an outer diameter of the terminal ends 30 is nearer a central axis (x) of the compact encapsulated initiator assembly 10 than an outer boundary or edge of the initiator chip 12. This spatial relationship of the terminal ends 30, closer to the central axis (x) than the outer boundary or edge of the initiator chip 12 can help reduce the overall width or outer diameter of the compact encapsulated initiator assembly 10. The terminal ends 30 can include an axially extending slot 42 that permits the female cylindrical electrical connectors to frictionally hold the prong shaped electrical conductors they receive. However, it should be appreciated that the terminal ends 30 can be shaped differently. For example, the terminal ends 30 can be deformed from a planar shape to form male cylindrical electrical connectors capable of releasably receiving female shaped electrical conductors that slide over an outer diameter of the male cylindrical electrical conductors.

A shaped composite housing 36 can be formed over the initiator chip 12, the electrically non-conductive substrate 16, at least a portion of the bridge 18, the first terminal 24, and the second terminal 24. Apertures 38 can be provided adjacent to the terminal ends 30 for receiving electrical conductors of the ordnance. An aperture 38 can also be provided to permit the functioning of the initiator chip and input charge 14. The shaped composite housing 36 can completely encapsulate the elements of the compact encapsulated initiator assembly 10 forming a fluid tight seal. The shaped composite housing 36 can be formed from one of many different composites using a particular technique. For instance, the shaped composite housing 36 can be formed over the elements of the compact encapsulated initiator assembly 10 using injection molding, such as overmolding, with a composite material selected based on the ordnance that will receive the assembly 10. A mold can be used having a shape that defines the surface contours of a particular outer diameter of the shaped composite housing 36. In this implementation, the shaped composite housing can have an outer surface shaped as a cylinder. But it should be appreciated that other outer shapes are possible as well. After the shaped composite housing 36 is formed its outer surface can be quite compact and have an outer diameter equal to or less than 0.235 inches in one embodiment, or in another embodiment have an outer diameter equal to or less than 0.190 inches.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A compact encapsulated initiator assembly comprising:

an initiator chip, formed on an electrically non-conductive substrate, having a plurality of bridge contacts;

a first terminal, including a first terminal end, configured to releasably and electrically couple with an electrical conductor of ordnance, and a first chip end that electrically couples with one of the bridge contacts;

a second terminal, including a second terminal end, configured to releasably and electrically couple with another electrical conductor of ordnance, and a second chip end that electrically couples with another of the bridge contacts; and a shaped composite housing encapsulating at least some of the initiator chip, the first terminal, and the second terminal, wherein at least a portion of an outer diameter of the first terminal end and an outer diameter of the second terminal end are positioned nearer a center axis than an outer edge of the initiator chip.

2. The compact encapsulated initiator assembly recited in claim 1, wherein the initiator chip is an exploding foil initiator.

3. The compact encapsulated initiator assembly recited in claim 1, further comprising an aperture in the shaped composite housing that is adjacent an input charge.

4. The compact encapsulated initiator assembly recited in claim 1, wherein the first chip end or the second chip end includes a planar section.

5. The compact encapsulated initiator assembly recited in claim 1, wherein the first terminal end and the second terminal end are formed from a material having a substantially uniform thickness.

6. The compact encapsulated initiator assembly recited in claim 1, wherein the first terminal end and the second terminal end are formed as female cylindrical electrical conductors.

7. The compact encapsulated initiator assembly recited in claim 6, the female electrical conductors each including an axially extending slot.

8. The compact encapsulated initiator assembly recited in claim 1, wherein an outer surface of the shaped composite housing is cylindrically shaped.

9. The compact encapsulated initiator assembly recited in claim 1, wherein the initiator chip faces one axial direction and at least one of the first terminal end or the second terminal end faces an opposite axial direction.

10. The compact encapsulated initiator assembly recited in claim 1, wherein an outer diameter of the shaped composite housing is less than or equal to 0.235 inches.

11. The compact encapsulated initiator assembly recited in claim 1, wherein an outer diameter of the shaped composite housing is less than or equal to 0.190 inches.

* * * * *